United States Patent [19]

Seiler et al.

[11] Patent Number: 4,530,205

[45] Date of Patent: Jul. 23, 1985

[54] METHOD AND APPARATUS FOR MAKING STRANDED WIRES OR CABLES

[75] Inventors: Ernst Seiler, Romanshorn, Switzerland; Wilhelm Lang, Lindau, Fed. Rep. of Germany

[73] Assignee: Fatzer AG, Romanshorn, Switzerland

[21] Appl. No.: 530,487

[22] Filed: Sep. 9, 1983

[30] Foreign Application Priority Data

Sep. 14, 1982 [CH] Switzerland ..... 5435/82

[51] Int. Cl.[3] ..... D07B 5/10; D07B 3/00; D07B 7/00

[52] U.S. Cl. ..... 57/9; 57/311

[58] Field of Search ..... 57/215, 9, 311, 138

[56] References Cited

U.S. PATENT DOCUMENTS 2,156,652 5/1939 Harris ..... 57/9 X
3,128,799 4/1964 Kerr ..... 57/138 X
3,142,145 7/1964 Blanchard ..... 57/9
4,064,685 12/1977 Polke ..... 57/311

*Primary Examiner*—Donald Watkins
*Attorney, Agent, or Firm*—Frishauf, Holtz, Goodman & Woodward

[57] ABSTRACT

To provide a predetermined pre-set twist or rotation about an angle corresponding at least approximately through the spiraling angle of strands (8) wrapped about a core wire or strand (48), the individual surrounding strands are passed through directionally orienting dies (20, 28) which may receive circular strands and impart an approximately truncated wedge-shape thereto, or directly receive pre-shaped strands. The orienting dies are angularly adjustable in a holder (26) which, in turn, is rotatable about an axis transverse to the axis of the die opening, all the dies being secured to a carrier plate which is axially adjustable with respect to the stranding die (7) of the apparatus.

17 Claims, 10 Drawing Figures

METHOD AND APPARATUS FOR MAKING STRANDED WIRES OR CABLES

The present invention relates to a method and apparatus to manufacture stranded wires or cables and more particularly to an arrangement of the stranded wires or cables in which spirally located strands are placed around a center strand.

BACKGROUND

In the manufacture of ropes, cables, stranded wires and the like it is customary to wrap respective strands about a center or lead strand, and then compact the spirally wrapped strands, for example by drawing the finished cable, rope or wire through a die to reduce the outer diameter; alternatively, various types of roller apparatus may be used. Reduction of the outer diameter causes the formation of the cross-sectional shape of the respective wires fixed against each other, due to the substantial radial pressures which are applied thereagainst at the compacting position. This deformation causes the stranded wires, cables, ropes, or the like to become comparatively stiff, and resistant to bending; further, due to elastic spring-back, the outer circumference of the wires and cables becomes rough and undulating. The contacting zones of the strands, among each other and within the interior of the rope, cable or wire are surface or area-like, rather than providing for line contact. The circumference departs from its circular shape, although a circular configuration is desired.

THE INVENTION

It is an object to provide a stranded wire, cable, or rope, or the like which has improved flexibility with respect to the prior-art products of this kind and has an outer surface which more closely approaches a complete circle than heretofore possible.

Briefly, strands, which are guided around a central or core wire have a cross-sectional shape which departs from round and, rather, have approximately truncated wedge shape. These strands are then radially oriented by imparting to the strands a twist about a predetermined angle corresponding preferably at least approximately to the spiraling angle of the strand, when assembled about the core wire, to thereby form the finished stranded wire, cable, rope, or the like.

The portion of the deformed strand which will form the outer circumference of the stranded wire, cable, rope, or the like—hereinafter for short "stranded product"—can be shaped in a guide die to have a slightly rounded circumference, so that, when the strand is assembled to the stranded product, the overall circumference will approach a circle.

The method, and the product has the advantage that the wear on the strand, as well as on guide elements with which the product may cooperate is substantially reduced. The frictional forces within the interior of the stranded product, likewise, are reduced and there is less heating due to sliding friction of the respective strands.

The stranded product has the further advantage that the space factor thereof is improved, that is, the degree of material per cross-sectional area is higher than before. The strands will receive their precise radial orientation already upon manufacture so that the circular shape of the finished stranded product will be maintained to an optimum extent, so that, additionally, the finished stranded product will be free from uncurling, or untwisting.

DRAWINGS

DETAILED DESCRIPTION

Figure 1:
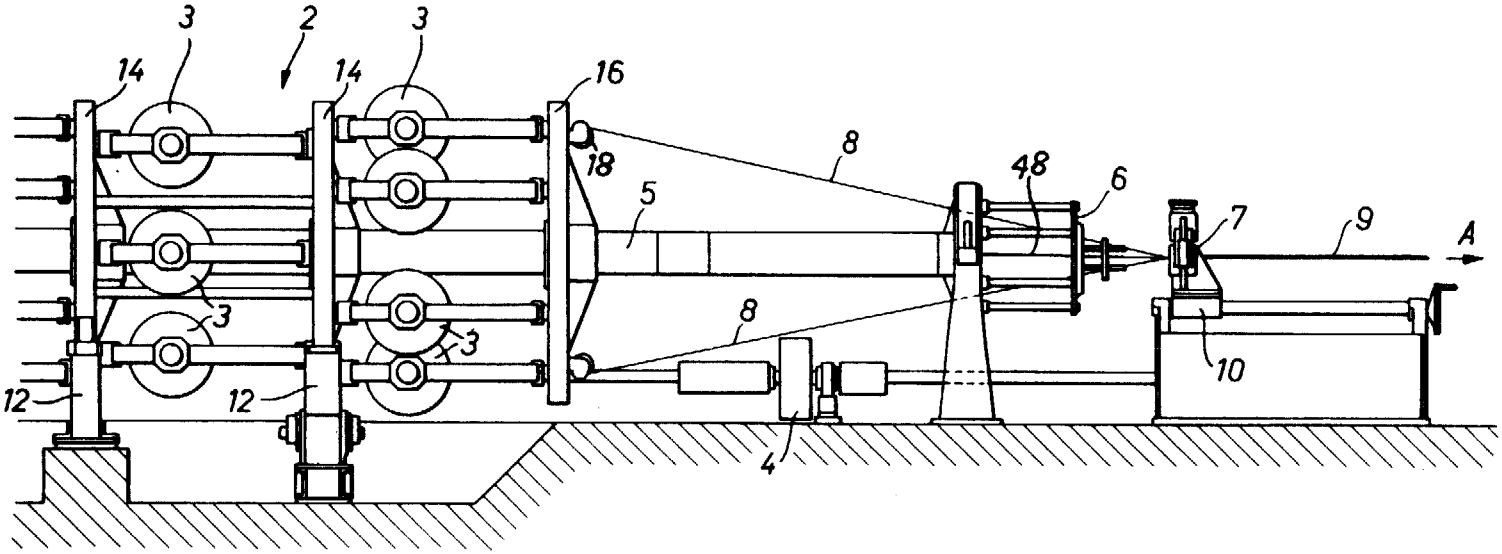
FIG. 1 is a general schematic side view of the stranded produce manufacturing machine.
Figure 2:
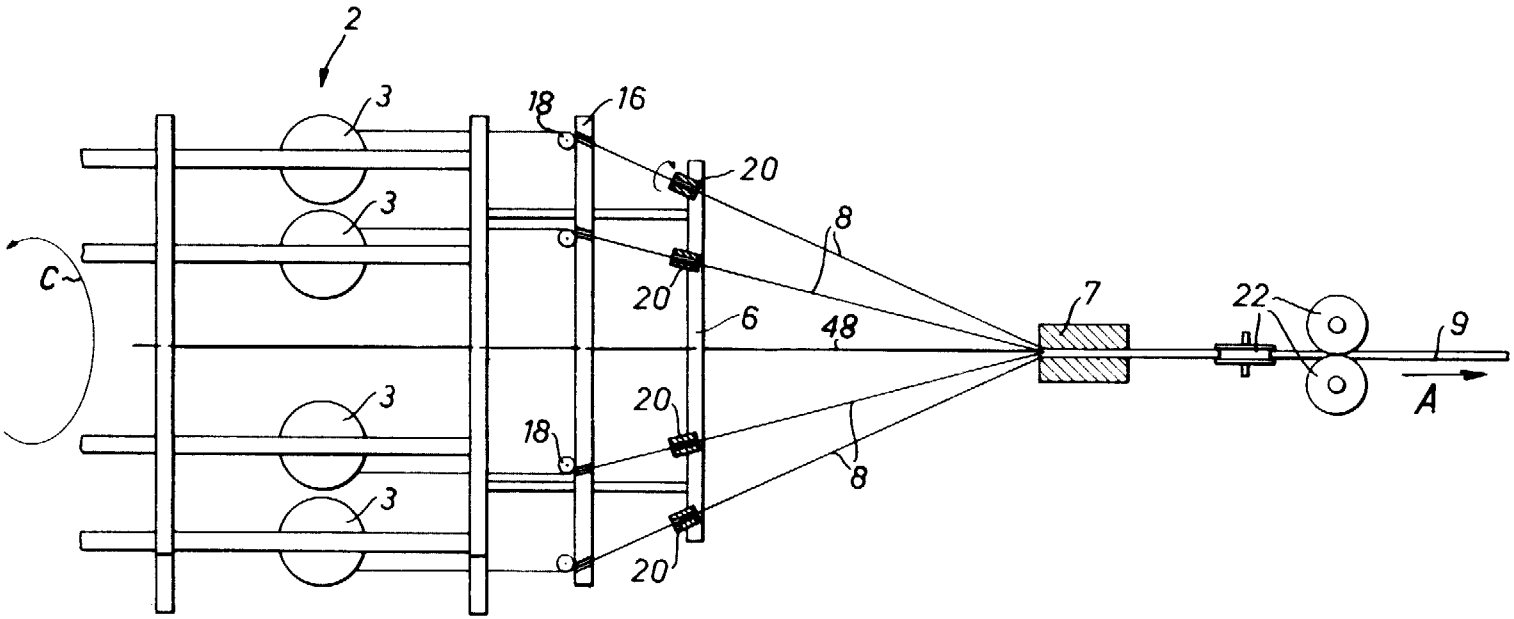
FIG. 2 is a schematic illustration of the guidance of the strand.

The present invention can be used with a standard cable or rope-making machine, shown, generally, in FIG. 1. A cage 2 is located about a horizontal central support 5. A plurality of strand-supply drums, or wheels 3 are located on respective cages. The required strands needed for the stranded product are stored on these wheels. A motor supplies rotary power to disk-shaped yokes or carriers 14, supported on rollers 12. The disk-shaped carriers rotate, together with the central support 5 and the strand-supply wheels 3 about a horizontal axis, as schematically indicated in FIG. 2 by arrow C.

Figure 3:
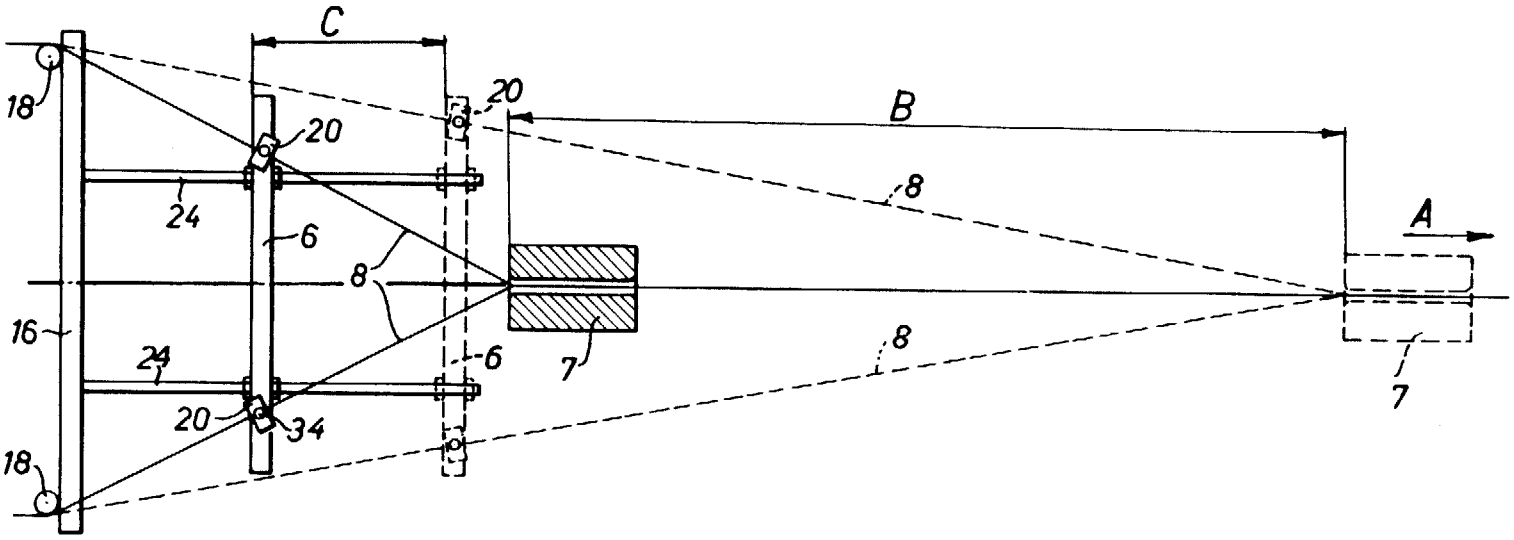
FIG. 3 is a schematic illustration of the effect of axial shift of stranding dies.

A plurality of individual strands 8—of which only two are shown in FIGS. 1 and 3 for simplicity—are guided about guide rollers, or guide shoes 18, which are secured to a guide disk 16 which is rotatable with the central support 5. The respective individual strands 8 are then guided to a carrier plate 6 which carries orientation dies. The carrier plate 6 rotates with the central support 5 which, for example, is tubular. A central, circular core wire 48 (FIGS. 2, 8, 9) is guided through the core; with the exception of the central core wire, the carrier plate 6 carries dies 20 which are associated with each of the respective surrounding strands 8.

The strands 8, after passing through the orientation dies 20, then reach a stranding die 7, which has a central opening. The stranding die 7 causes the individual strands to wrap spirally about the central core wire 48 to form the stranded product 9. The stranded product 9 is drawn off in the direction of the arrow A—see FIG. 1. A plurality of such stranded products can be used to form the individual strands 8 if further, thicker stranded products are needed. Thus, the reels 3 may carry not only individual, single strands, but already stranded products which, if supplied from the reels 3, will also be deemed to be "strands". The respective stranded product may have the shape shown in FIG. 8 or 9.

As best seen in the schematic representation of FIG. 3, it is possible to shift the stranding die A axially about the dimension B with respect to the disk or plate 16 which carries the rollers or shoes 18. The carrier plate 6, likewise, can be shifted axially with respect to the plate 16 by the distance C. The distance of the carrier plate 6 from the plate 16 can be smaller or larger than the distance of the plate 6 from the stranding die 7. By changing the respective distances B and C it is possible to change the pitch of the spiral of the strands 8 which are wrapped around the core wire 48. To control the pitch, or change the pitch, it is necessary that the dies 20 can tilt, so that the angular direction of the path through the dies 20 can be changed. The dies 20 are secured to the carrier plate 6 such that they can be rotated about an axis which is at right angles to the respective strand 8 crossing through the dies 20. Additionally, the axis of rotation passes at right angles through a plane which is formed by the respective strand 8 and the central core wire 48.

Figure 4:
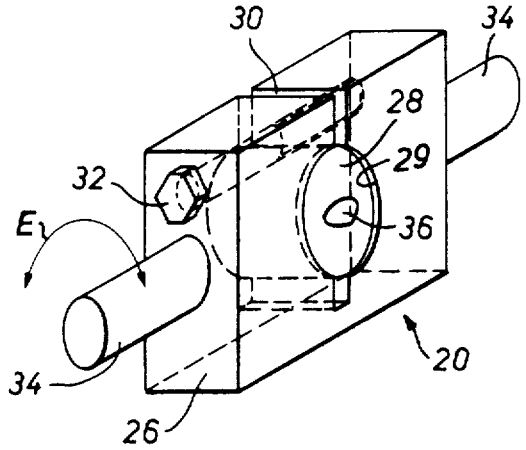
FIG. 4 is a perspective, partly phantom view of an orientation die.

The construction of the dies 20 is best seen in FIG. 4. Two co-axially arranged cylindrical pins 34 are provided, extending from a die holder 26 which forms a housing for a die element 28. The pins 34 hold the housing 26 pivotably, or rotatably in, or on the carrier plate 6. The holder, or housing has the die 28 inserted therein. The die 28 can also be referred to as a matrix. Die 28 is located in a cylindrical bore 29 of the housing 26 and can be rotated therein about an axis transverse to the shaft axes of the pins or cylindrical extension 34. Rotation about the shaft axes is shown by arrow E. The guide 28 can be clamped at a desired angular position within the circular opening or bore 29 by tightening a screw 32 which passes through a slit 30 formed in the housing or holder 26. Tightening the screw 32 after alignment of the die 28 permits orientation of a non-circular opening 36 within the guide 28 in a desired angular direction. Of course, other arrangements may be used, for example, the circumference of the die 28 may be formed with a gearing which engages a worm gear passing in the direction of the screw 32 for adjustment thereby. The worm gear, replacing the screw 32 should be externally accessible, permitting precise and easily reproducible change of the angular position of the die 28.

The opening 36 within the die 28 is non-circular, thus forcing a strand 8 to assume a predetermined angular relative position with respect to the core strand 48, and hence provide for spiraling thereabout.

Figure 5:
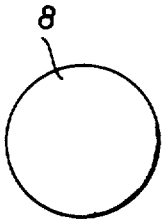
FIG. 5 is an illustration of the cross section of a strand before deformation.
Figure 6:
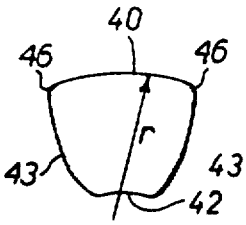
FIGS. 6 and 7 illustrate two embodiments of cross sections of deformed strands.
Figure 7:
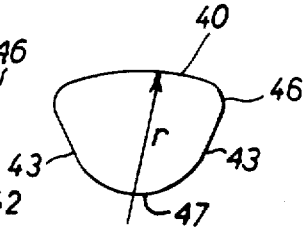

The shape of the opening 36 in the die 28, which determines the shape which the strand 8 will have as it leaves the die, is shown, in two preferred embodiments, in FIGS. 6 and 7. The die 28 can be formed as a pure direction-imparting die, in which a strand, pre-formed as in FIG. 6, or FIG. 7, merely has a desired direction imparted thereto; alternatively, the die can receive a strand as shown, for example, in FIG. 5, and re-shape the cross section thereof so that the circular form of FIG. 5 is changed to have the desired final shape as shown, for example, in FIG. 6 or 7, respectively. The opening 36 in the die is located centrally within the die (see FIG. 4), and in alignment with the pins 34. Upon rotation of the die within the holder 26, the position of the opening will not shift essentially with respect to the axis of the pins 34.

Embodiment of FIG. 6: The cross-sectional shape departs from the circular form of FIG. 5, FIG. 6 showing the cross section as the strand leaves the die opening 36. The strands 8 are to form the stranded product 50—see FIG. 8 or 9—and, therefore, the outer circumference which should later on form the outer circumference of the stranded product, is formed with a convex portion 40, which corresponds as closely as possible, or desirable, within the tolerances of the product, to the radius r of the stranded product. A concave portion 42 is formed in the region of the strand opposite the outer circumference 40. The radius of the concave portion 40 corresponds at least approximately to the radius of the core wire 48. The side portions 43 which join the end surfaces 40, 42 are preferably slightly outwardly bowed to have the convex shape shown in FIG. 6 and retain the slight outward bowing after passage through the stranding die 7. The transition 46 between the convex portion 40 and the lateral surfaces 43 is rounded.

Figure 9:
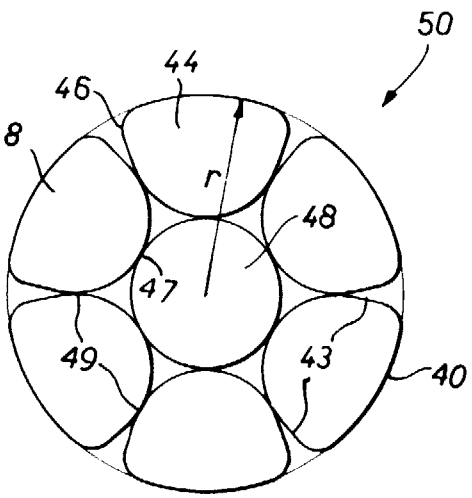
FIG. 9 is a cross section of the finished stranded product with the strand of FIG. 7.
Figure 8:
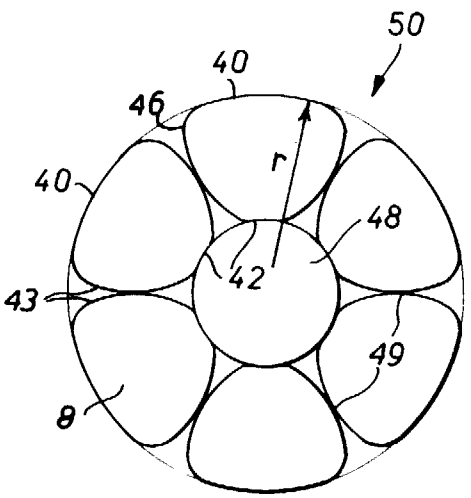
FIG. 8 is a cross section of the thinnest stranded product with the strands of FIG. 6.
Figure 10:
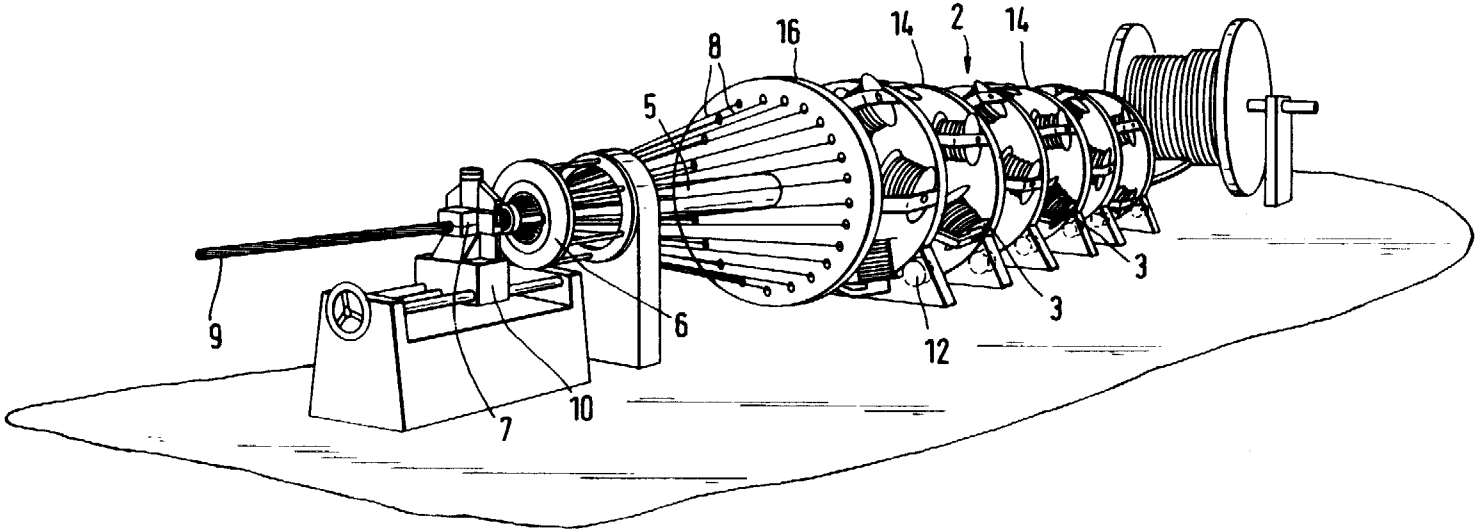
FIG. 10 is a perspective view of the machine.

Embodiment of FIG. 7: The strand 7 has an outer surface 40 which, like the strand of FIG. 6 is convex, the radius corresponding, at least approximately, to the radius r of the stranded product. The central portion 47, which will be adjacent the core wire 48 is formed, however, also convexly so that the contact zone between the central portion and the core wire 48 will be a line contact, rather than a surface contact as in FIG. 6. The shape of the finished product is shown in FIGS. 8 and 9, respectively. The overall diameter of the finished product made of strands of FIG. 6, as shown in FIG. 8, may be slightly smaller than that of the product made of the strands of FIG. 7, and shown in FIG. 9. Due to the line contact of the surrounding strands with the core strand 48, however, the slightly larger stranded product will be more flexible.

The stranding die 7 joins the respective strands 8 to the core wire 48. The strands 8 are hardly deformed, if at all, in the stranding die 7. The strands 8 are supplied to the stranding die in angularly oriented, radially properly angled direction. Thus, there is hardly any radial contraction due to the presence of the stranding die 7. Consequently, the respective strands 8 among each other at the contact point 49 will retain some slight mutual movability; the respective strands can slightly slide, or roll off with respect to each other due to the line contact 49—see FIGS. 8, 9. This is in contrast to conventional manufacture in which the stranding die causes substantial contraction and compression, either by compressing the overall stranded product or by compression rollers. This will result in uncontrolled formation of contact line surfaces or the like of the respectively mutually engageable wires which interferes with respective movability or shiftability of the individual strands which may occur if the stranded product is bent or guided around deflection rollers and the like. The resulting stranded product, as shown in FIGS. 8 and 9, in contrast, has a substantially increased lifetime.

The dies 20, thus, provide angular re-orientation of the strands before they reach the stranding die 7. The angular reorientation of strands which are not circular in cross section but, rather, have somewhat truncated wedge-shape cross sectional appearance, with a convex outer surface, results in an overall outer surface of the stranded product which is essentially circular, and essentially smooth, with only small gaps between the strands, shown exaggerated in FIGS. 8 and 9. Each one of the respective dies 20, with the die elements 28 therein, can be so adjusted by angular twist within the housing 26 that, after the respective strand has passed through the stranding die 7, the outwardly convex bowed portion 40 of any strand 8 is placed and positioned in a circle about the core strand with an outer diameter corresponding to the desired diameter of the stranded product with radius r. The torsional resilient spring-back effect which is present in strands supplied only to a stranded die is effectively eliminated, so that the strands will have little tendency to unwind, or uncurl since the pre-deformation of the strands, in accordance with FIGS. 6 and 7, and the angular orientation by the setting of the dies 28 in the holders 26, as well as the positioning of the holders 26 on the carrier plate 6 by the shaft 34 provides for spiraled placement of the strands about the core wire and thus elimination of residual tension or other forces.

It is even possible to locate strands about a central core wire with slight lateral play or clearance, by suitably selecting the diameters of the respective strands, or the number thereof above the core, leaving some space between the contact points 49 (FIGS. 8, 9). Leaving a slight amount of play substantially increases the flexibility of the stranded product, by decreasing frictional forces which arise within the stranded product, and consequently decreasing heating of the stranded product if it is bent, for example by being passed about a deflection roller or the like. The apparatus and method is suitable for use with various types of stranding or rope-making machinery, and can be used in connection with the cage, or basket-type machine illustrated in FIGS. 1–3, as well as with conventional tubular stranding machines.

Various changes and modifications may be made without departing from the inventive concept.

We claim:

1. Method of making stranded wires, cables, ropes or the like having a plurality of strands (8) supplied in the form of wires having essentially circular cross section, said plurality of strands being guided to respective guide means (18) for wrapping about a central or inner core (48) at a stranding position, comprising the steps of deforming the supplied strands of essentially circular cross section to assume the shape of, in cross section, approximately truncated wedge shape, while simultaneously radially orienting said so deformed strands to impart an angular orientation to said strands about an angle corresponding at least approximately to the spiral angle of the strand when assembled about the central core (48);

supplying the strans (8) having, in cross section, said approximately truncated wedge-shaped form to the central core;

and laying the strands spirally about the central or inner core.

2. Method according to claim 1 wherein the strands having in cross section said approximately truncated wedge-shape have a convex surface at the region forming the outer circumference of the final stranded wire, cable, or rope, with a radius corresponding at least approximately to the radius (r) of the final stranded product.

3. Method according to claim 1 wherein said step of deforming said wire includes the step of forming a convex surface at the region at which the strands will form the outer circumference of the final product forming said cables, wires, or ropes, the radius of curvature of said convex region corresponding approximately to the radius of said final products.

4. Stranding apparatus to make a stranded product, said apparatus having a rotatable supply cage (2);

a plurality of strand supply rollers (3) secured to the supply cage and supplying wire strands (18) of essentially circular cross section;

a strand guidance disk (16) and guide means for individual strands from the strand supply means;

a stranding guide (7) spaced from the guide means, and comprising, in accordance with the invention, a holder plate (6) concentric with said cage;

a plurality of orienting and shaping dies (20) secured to the holder plate, said orienting and shaping dies being positioned between the stranding guide (7) and the cage (2);

adjustable holding means (30, 32) for holding the orienting and shaping dies (20) on said holder plate, said orienting and shaping dies having exit openings (36) having at least approximately truncated wedge shape, said dies being adapted to receive said strands (8) and deform said strands to assume, in cross section, an essentially truncated wedge shape;

and wherein the openings in said dies are oriented about a predetermined angle with respect to the axis of rotation of the rotatable supply cage and the through-put axis of the stranding guide (7), said predetermined angle corresponding at least approximately to the spiral angle of the strands when assembled about a central or inner core (48).

5. Apparatus according to claim 4 wherein the holding means secure the dies (20) to the carrier plate (6) for pivoting, or rotary movement about an axis (34) extending at right angles to the longitudinal direction of the die opening;

and further including rotary adjustment means (32) to permit rotational adjustment of the dies (20) to impart said angular orientation to the strands about said predetermined angle.

6. Apparatus according to claim 5 wherein the orienting dies (20) have an outer cylindrical surface;

and the holding means includes die holders (26) having a similar cylindrical opening and retaining said dies (20) therein in predetermined rotationally adjustable position.

7. Apparatus according to claim 4 wherein the dies (20) include die elements having a shape which imparts to the strands a convex surface at the region forming the outer circumference of the final stranded product having a radius of curvature which is at least approximately that of the final wire, cable, or rope (50).

8. Apparatus according to claim 7 wherein the dies additionally impart a concave surface (42) to the strands diametrically opposite the convex surface (40), the radius of curvature of the concave surface corresponding, at least approximately, to the radius of the core wire (48).

9. Apparatus according to claim 4 wherein the carrier plate (6) is axially relatively shiftable with respect to the stranding guide (7).

10. Stranding apparatus to make a stranded product having a rotatable supply cage (2);

a plurality of strand supply rollers secured to the supply cage, and supplying wire strands (8);

a strand guidance disk (16) and guide means for individual strands (8) from the strand supply means;

a stranding guide (7) spaced from the guide means, and comprising, in accordance with the invention, a holder plate (6) concentric with said cage;

a plurality of orientating dies (20) secured to the holder plate, said orienting dies having exit openings (36) having, at least approximately, truncated wedge shape, said orienting dies being positioned between the stranding guide (7) and said cage (2);

and adjustable holding means for holding the orienting dies (20) on said holder plate, comprising means for securing the orienting dies (20) to the carrier plate (6) for pivoting or rotary movement about an axis (34) extending at right angles to the longitudinal direction of the die opening;

and rotary adjustment means (32) to permit rotational adjustment of the orienting dies (20) to impart an angular orientation to the strands about a predetermined angle, said predetermined angle corresponding, at least approximately, to the spiral angle of the strands, when assembled about a central or inner core (48).

11. Apparatus according to claim 10, wherein the orienting dies (20) have an outer cylindrical surface;

and the means for securing the orienting dies to the carrier plate includes dies holders (26) having a similar cylindrical opening and retaining said orienting dies (20) therein in predetermined rotationally adjustable position.

12. Apparatus according to claim 10, wherein the dies (20) include die elements having a shape which imparts to the strands a convex surface at the region forming the outer circumference of the final stranded product having a radius of curvature which is at least approximately that of the final wire, cable, or rope (50).

13. Apparatus according to claim 12, wherein the dies additionally impart a concave surface (42) to the strands diametrically opposite the convex surface (40), the radius of curvature of the concave surface corresponding, at least approximately, to the radius of the core wire (48).

14. Apparatus according to claim 10, wherein the carrier plate (6) is axially relatively shiftable with respect to the stranding guide (7).

15. Apparatus according to claim 11, wherein the carrier plate (6) is axially relatively shiftable with respect to the stranding guide (7).

16. Apparatus according to claim 10, wherein the die (20) comprises a die element, said die opening being formed in the die element;

and wherein the opening in the die element is positioned essentially centrally within the die element and in alignment with said axis (34) extending at right angles to the longitudinal direction of the die opening.

17. Apparatus according to claim 16, wherein said die element (28) has an outer cylindrical surface;

and the die holders (26) have a similar cylindrical opening and means for retaining said dies therein in predetermined rotationally adjustable position.

* * * * *